US008251793B2

(12) United States Patent
Enzminger et al.

(10) Patent No.: US 8,251,793 B2
(45) Date of Patent: Aug. 28, 2012

(54) APPARATUS AND METHOD FOR FACILITATING GAME PLAY IN AN ELECTRONIC LOTTERY GAME NETWORK

(75) Inventors: Joseph R. Enzminger, Austin, TX (US); Jefferson C. Lind, Austin, TX (US); Clifton E. Lind, Austin, TX (US)

(73) Assignee: Multimedia Games, Inc., Austin, TX (US)

( * ) Notice: Subject to any disclaimer, the term of this patent is extended or adjusted under 35 U.S.C. 154(b) by 0 days.

(21) Appl. No.: 13/345,322

(22) Filed: Jan. 6, 2012

(65) Prior Publication Data

US 2012/0108314 A1 May 3, 2012

Related U.S. Application Data

(63) Continuation of application No. 11/854,367, filed on Sep. 12, 2007, now Pat. No. 8,092,294, which is a continuation of application No. 10/842,609, filed on May 10, 2004, now Pat. No. 7,326,111, which is a continuation of application No. 09/503,650, filed on Feb. 14, 2000, now Pat. No. 6,733,385.

(51) Int. Cl.
*A63F 9/24* (2006.01)

(52) U.S. Cl. ..... 463/17; 463/18

(58) Field of Classification Search ..... 463/17, 463/18

See application file for complete search history.

(56) References Cited

U.S. PATENT DOCUMENTS 4,494,197 A 1/1985 Troy et al.
4,652,998 A 3/1987 Koza et al.
4,817,951 A 4/1989 Crouch et al.
5,042,809 A 8/1991 Richardson
5,092,598 A 3/1992 Kamille
5,118,109 A 6/1992 Gumina
5,324,035 A 6/1994 Morris et al.
5,407,199 A 4/1995 Gumina (Continued)

FOREIGN PATENT DOCUMENTS

EP 0 625 760 A1 11/1994

(Continued)

OTHER PUBLICATIONS

Communication pursuant to Article 96(2) EPC dated Jul. 19, 2005 for European Application No. 01 925 096.8-2221 (6 pages).

(Continued)

*Primary Examiner* — Pierre E Elisca

(74) *Attorney, Agent, or Firm* — Nathan H. Calvert; Russell D. Culbertson; The Culbertson Group, P.C.

(57) ABSTRACT

At least one pool of game play records is stored at a central processing system. Each game play record includes a record index selected from a set of unique index values, each associated with a different result type. A record index associated with a particular game play record is communicated from the central processing system to the player terminal in response to a game play request which a player has entered at the player terminal. The player terminal responds to the received record index by generating display commands using data at the player terminal to produce a graphic representation at the player terminal. This graphic representation is consistent with the result type associated with the index value comprising the particular record index which has been communicated to the player terminal.

16 Claims, 3 Drawing Sheets

U.S. PATENT DOCUMENTS

| | | | | |
|---|---|---|---|---|
| 5,456,465 | A | 10/1995 | Durham | |
| 5,586,937 | A | 12/1996 | Menashe | |
| 5,588,913 | A | 12/1996 | Hecht | |
| 5,779,545 | A | 7/1998 | Berg et al. | |
| 5,797,794 | A | 8/1998 | Angell | |
| 5,871,398 | A | 2/1999 | Schneier et al. | |
| 6,024,640 | A | 2/2000 | Walker et al. | |
| 6,113,492 | A | 9/2000 | Walker et al. | |
| 6,210,276 | B1 | 4/2001 | Mullins | |
| 6,280,328 | B1 | 8/2001 | Holch et al. | |
| 6,358,151 | B1 | 3/2002 | Enzminger et al. | |
| 6,402,614 | B1 | 6/2002 | Schneier et al. | |
| 6,524,184 | B1 | 2/2003 | Lind et al. | |
| 6,537,150 | B1 | 3/2003 | Luciano et al. | |
| 6,595,855 | B2 | 7/2003 | Sako | |
| 6,811,484 | B2 * | 11/2004 | Katz et al. | 463/17 |
| 2001/0039204 | A1 | 11/2001 | Tanskanen | |
| 2006/0166725 | A1 * | 7/2006 | Saffari et al. | 463/2 |
| 2006/0166729 | A1 * | 7/2006 | Saffari et al. | 463/17 |

FOREIGN PATENT DOCUMENTS

| | | | |
|---|---|---|---|
| EP | 0 829 834 | A2 | 3/1998 |
| EP | 0 829 834 | A3 | 12/1999 |
| GB | 2 128 486 | A | 5/1984 |

OTHER PUBLICATIONS

Decision to Refuse a European Patent Application for EP Application No. 01 925 096.8-2221 dated Feb. 17, 2006 (10 pages).

Canadian Examination Report dated May 25, 2006 for Canadian Application No. 2,399,113 (4 pages).

* cited by examiner

APPARATUS AND METHOD FOR FACILITATING GAME PLAY IN AN ELECTRONIC LOTTERY GAME NETWORK

CROSS-REFERENCE TO RELATED APPLICATIONS

This application is a continuation of U.S. patent application Ser. No. 11/854,367, filed Sep. 12, 2007 and entitled "APPARATUS AND METHOD FOR FACILITATING GAME PLAY IN AN ELECTRONIC LOTTERY GAME NETWORK," now U.S. Pat. No. 8,092,294 B2, which is a continuation of U.S. patent application Ser. No. 10/842,609, filed May 10, 2004 now U.S. Pat. No. 7,326,111 B2 and entitled "APPARATUS, METHOD, AND PROGRAM PRODUCT FOR FACILITATING GAME PLAY IN AN ELECTRONIC LOTTERY GAME NETWORK," which is a continuation of U.S. patent application Ser. No. 09/503,650, filed Feb. 14, 2000 now U.S. Pat. No. 6,733,385 B1 and entitled "APPARATUS, METHOD, AND PROGRAM PRODUCT FOR FACILITATING GAME PLAY IN AN ELECTRONIC LOTTERY GAME NETWORK." The benefit of each of these prior patent applications is hereby claimed in the present application pursuant under 35 U.S.C. §120. The entire content of each of these prior applications is incorporated herein by this reference.

TECHNICAL FIELD OF THE INVENTION

This invention relates to electronically implemented games of chance and, more particularly, to data communications in electronic lottery-type games. The invention encompasses methods and apparatus for facilitating game play in an electronic lottery-type game.

BACKGROUND OF THE INVENTION

Lottery-type games are popular sources of revenue for governmental agencies and charitable organizations. As used in this disclosure, a "lottery-type game" comprises a game having a predetermined number of payouts or prizes and a determined chance of winning. For example, a lottery-type game may comprise a scratch-off or pull-tab game having a number of pre-printed tickets. Each ticket has some type of printed result indicator which indicates if the particular ticket is a winning ticket and, if the ticket is a winning ticket, indicates the prize or payout. The result indicator is commonly covered with some opaque cover material which may be scratched off or otherwise removed to reveal the indicator below. Thus, the ticket purchaser cannot see if the ticket is a winning ticket until purchasing the ticket and removing the opaque cover material.

Lottery-type games may be implemented through computer-based, electronic systems. U.S. Pat. No. 6,524,184 B1 to Lind et al. describes an electronic, multi-level lottery type game in which the play of the game may imitate a regular casino game. However, the game described in this patent is played with pools of game play records having predetermined outcomes similar to standard paper ticket based lottery games. Thus, the game provides the excitement of a regular casino-type game such as draw poker, for example, but with the security, verifiability, and fixed chances of winning provided by paper ticket based lottery games.

Electronically implemented lottery-type games may be implemented using a central processing system for storing the various pools of game play records and for distributing the game play records to player terminals which are in communication with the central processing system. The player terminals provide a display device for displaying information to the player, an arrangement for accepting a wager, and an arrangement for providing inputs from the player. A player enters the electronically implemented lottery-type game by making a game play request at a player terminal. In response to a game play request entered by the player, the central processing system sends information regarding a particular game play record to the player terminal. The player terminal then displays the information regarding the game play, and, in the case of the system described in prior related U.S. Pat. No. 6,524,184 B1 to Lind et al., allows the player to make a response. This response enters the player in another or second level lottery-type game and results in information regarding a second level game play being communicated from the central processing system to the player terminal.

The prior electronic game described in U.S. Pat. No. 5,324,035 to Morris et al. incorporates all information required to define a game play into a video ticket. The incorporated information includes data for the various graphic symbols to be displayed to the player through the player terminal. This arrangement results in relatively large amounts of data having to be transferred to the player terminal for each game play.

The prior electronic game described in U.S. Pat. No. 4,494,197 to Troy et al. utilizes a counter register and winning ticket table at a central processor. In response to a play request from a player terminal, the value in the counter register is incremented and then the winning ticket table is queried to determine if the resulting count corresponds to a winning electronic ticket. The central processor then sends back to the player terminal a packet of information including a winning or losing code as appropriate. The winning code includes the amount won on the play. The Troy Patent also suggests using the amount won to produce a graphic representation of the result at the player terminal. However, using the amount won on a play to communicate a winning ticket to a player terminal constrains the payout structure and graphics available in the game.

SUMMARY OF THE INVENTION

It is an object of the invention to provide a system which overcomes the above-described deficiencies and others in prior electronic lottery-type games. More particularly, it is an object of the invention to provide a method which reduces the amount of data transferred to the player terminals to communicate a game play in an electronic lottery-type game, and which provides flexibility in payout schedules as well as facilitates multi-level game play. A further object of the invention is to provide an apparatus to implement the method.

In order to accomplish these objects, game play records include or comprise a record index. The method according to the invention employs the record index to initiate a process using data stored at the player terminal to produce graphic representations at the player terminal. This method reduces the amount of data which must be communicated to the player terminal in response to a game play request. Also, the present method facilitates the play of interrelated, multi-level electronic lottery-type games which may imitate casino-type games while retaining the fairness and predetermined payouts associated with traditional paper ticket lottery games.

The invention includes the step of storing at least one pool of game play records at a central processing system (game play records are sometimes referred to herein simply as "records"). Each game play record includes a record index selected from a set of unique record index values (record index values are sometimes referred to herein simply as "index values"). In this sense "unique" means that the record index values in the set are each different and do not repeat within the set. Each record index value in the set of unique record index values is associated with a different result type. For example, in an electronic lottery game intended to imitate the play of draw poker, each unique record index value in the set is associated with a type of hand in draw poker. Each type of hand corresponds to a particular result type and thus the result type defines the particular type of hand. One unique record index value may be associated with the hand or result type "three of a kind" while another unique record index value may be associated with a "full house", for example. The number of different record index values used in a game is equal to the number of different result types available in the game.

It will be noted that each different record index value in the set of unique record index values is associated with a result type and not a specific embodiment of the result type. For example, a record index value associated with the result type "full house" does not specify the particular cards included in the hand, other than cards which amount to a "full house," that is, a pair of one type of card and three of another type of card. It will also be noted that the result type is not evident from the record index value which may be a numerical or alphanumeric value. Thus, the record index value is distinct from the result type and outcome (that is, the prize value) associated with a game play record and the game play record itself need not indicate whether it is a winning or losing record or any amount which may be won.

The method according to the present invention also includes the step of communicating the record index associated with a particular game play record from the central processing system to the player terminal. The particular record index is communicated to the player terminal in response to a game play request which a player has entered at the player terminal. The player terminal responds to the received record index by generating display commands to produce a graphic representation at the player terminal. This graphic representation is consistent with the result type associated with the particular record index which has been communicated to the player terminal.

Again using the example of a game adapted to imitate the play of draw poker, the graphic representation produced by the display commands comprises a graphic representation of a particular draw poker hand. The particular record index communicated to the player terminal may, for example, comprise a record index value associated with the result type "full house." In this example the graphic representation produced at the player terminal comprises a graphic representation of a collection of cards amounting to a full house.

All of the information and functions required to produce a particular graphic representation for a given record index are stored and maintained at the player terminal. Only the record index, comprising a value from the set of unique index values, must be communicated to the player terminal in order for the player terminal to display the results of the game play. This arrangement minimizes the amount of data which must be transferred to the player terminal in response to a game play request. Also, employing a record index readily accommodates multi-level game play and different types of game representations required to imitate different types of games or game types.

One preferred form of the invention also includes the step of maintaining an index table at the player terminal. The index table includes a different table entry for each unique record index value in the set of index values. Each table entry also preferably includes a prize value associated with the respective record index value. When the central processing system communicates a record index to the player terminal, the player terminal may query the index table with the record index to locate the table entry for the corresponding index value. The prize value included in the respective table entry may then be read and used to notify the player of the prize won in that play. Pointers to program resources necessary to generate an appropriate display may also be stored in the various table entries.

In some forms of the invention, numerous different games may be in play at any given time. Each set of game play records stored at the central processing system may utilize a set of record index values which is unique to that particular set of records or in which the individual values are defined uniquely for that set of game play records. In order to accommodate these multiple games using different record index value sets or differently defined record index values, each game play record may include a table identifier along with the record index. The table identifier is communicated to the player terminal along with the associated record index in response to a game play request from the player terminal. This table identifier is used at the player terminal to match the associated record index to the correct index table at the player terminal.

When applied to a multi-level lottery-type game where the levels are interrelated, the method according to the invention includes the step of maintaining a number of pools of additional level game play records at the central processing system. Each different pool of additional level game play records is associated with a permissible response which the player enters through the player terminal after the terminal produces a graphic representation in an initial game. Each additional level game play record includes an additional level record index which is preferably selected from the same set of unique record index values employed in the first level or initial game. Thus, record index values which make up the record indexes are associated with the same result types employed in the first level game.

When the player enters one of the permissible responses at the player terminal, the terminal communicates this permissible response to the central processing system as a game play request in an additional level game. The central processing system responds by communicating a particular additional level record index back to the player terminal. This additional level record index is associated with a particular additional level game play record stored at the central processing system. The player terminal responds to the additional level record index by generating additional level display commands to produce an additional level graphic representation at the player terminal. This graphic representation is consistent with the result type associated with the record index value comprising the received additional level record index and is also consistent with the permissible response made at the player terminal. In other words, the additional level graphic representation is consistent both with the received additional level record index and with the graphic representation from which the permissible response was made in the earlier level game.

Referring again to a lottery-type game adapted to imitate draw poker, the initial record index received at the player terminal may comprise a record index value associated with a "jacks or better" result type, for example. In this case, the player terminal responds to the initial record index by producing a graphic representation of a draw poker hand of the value "jacks or better." This graphic representation may include any hand fitting this description such as a hand showing a pair of kings, a 2 card, an 8 card, and a 9 card of suits which do not affect the value of the hand. In this example, one permissible response which may be entered by the player at the player terminal would be to hold the two kings and discard the remaining cards shown in the representation. As discussed in detail in prior related U.S. Pat. No. 6,524,184 B1 to Lind et al., this permissible response represents a game play request in a second level game which may be entitled the "pair of Jack's or better" game.

The central processing system responds to this permissible response/additional level game play request by communicating a particular additional level record index to the player terminal. In response to the particular additional level record index, the player terminal generates additional level display commands to produce at least a hand of "jacks or better," and including the two kings which the player has held in their permissible response. The result type associated with the record index value comprising the additional level record index may, for example, comprise the result type "three of a kind." In this example, the additional level graphic representation at the player terminal will include a representation of a draw poker hand with three kings and two additional cards which add no value to the hand. Two of the three kings in the hand will be representations of the same two cards held from the initial graphic representation. Thus, the additional level graphic representation is consistent both with the additional level record index and the permissible response/earlier level graphic representation.

The method according to the invention is implemented using computer program code. This program code includes play request processing program code executed at a central processing system processor, and display control program code executed at a suitable player terminal processor. In addition to the processor at the central processing system, the apparatus for implementing the invention also includes a game play storage device suitable for storing the various pools of game play records included in the game or games which may be played. Similarly, the player terminal also includes a suitable storage device for storing the index tables and other resources used at the terminal to generate the required display commands and produce the required graphic representations.

Utilizing record index values according to the present invention rather than complete descriptions of electronic lottery tickets reduces the amount of data which must be communicated from the central processing system to the player terminal. The present record index arrangement also provides a great deal of flexibility in the play of the lottery-type games and flexibility in payout schedules used in the games. In particular, the use of record indexes according to the invention facilitates the play of multi-level, interrelated lottery-type games which can be used together to closely imitate casino type games while providing all of the benefits of lottery-type games.

These and other objects, advantages, and features of the invention will be apparent from the following description of the preferred embodiments, considered along with the accompanying drawings.

DESCRIPTION OF PREFERRED EMBODIMENTS

Figure 1:
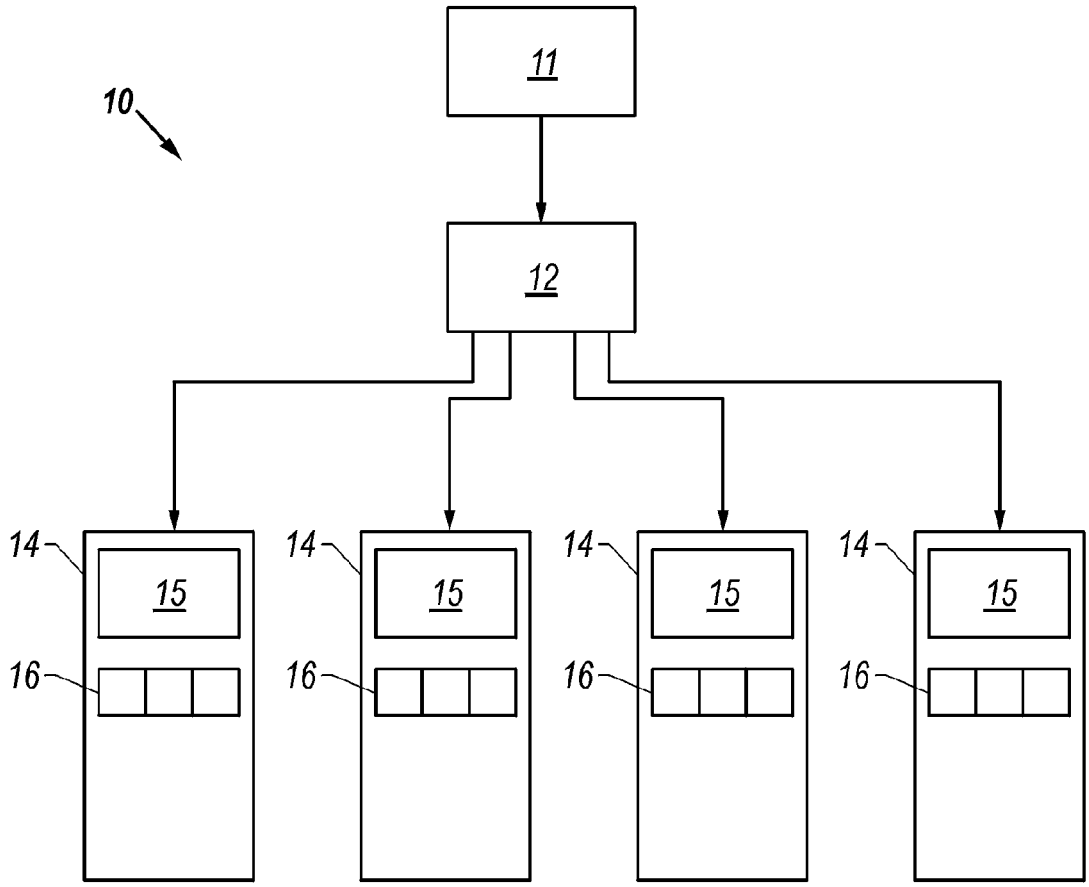
FIG. 1 is a diagrammatic representation of a gaming apparatus embodying one preferred form of the invention.

FIG. 1 shows a gaming apparatus 10 embodying the principles of the invention. The form of the invention shown in FIG. 1 is adapted to implement a gaming method described below with reference to FIG. 3. The invention is particularly well suited for implementing multi-level, interrelated lottery-type games which imitate casino type games as described in prior related U.S. Pat. No. 6,524,184 B1 to Lind et al. As with any electronic lottery-type game, the gaming apparatus and method according to the invention employ one or more pools of game play records. Each game play record is analogous to a scratch-off or pull-tab paper lottery ticket in that the status of the game play record as a winning or a losing record is predetermined. However, the game play records in the electronic lottery-type games comprise electronic data structures rather than physical tickets.

In the form of the invention illustrated in FIG. 1, the game play records are created at a game manufacturing computer system 11 and then stored in a game play storage device associated with a central processing system 12. Central processing system 12 is connected to communicate via suitable means with a plurality of player terminals 14. Although four player terminals 14 are shown in FIG. 1 for purposes of illustrating the invention, any number of player terminals may be included in an apparatus embodying the principles of the invention.

Each player terminal 14 includes a display 15 for displaying various game representations, and further includes an input device 16 for receiving player inputs including game play requests. The input device may comprise any type of input arrangement including one or more push button, key, or lever activated switches. Also, the input device may comprise a touch screen and thus be integrated with the display 15. Although not shown in the drawings, each player terminal 14 may also include an arrangement for receiving payments from a player and an arrangement for making payouts to the player. Payouts may be made using a coin or token dispensing arrangement (not shown) included in player terminal 14. Alternatively, or in addition to a coin dispensing arrangement, player terminal 14 may include a printer (not shown) for printing a ticket showing the player's winnings. The player may redeem this ticket through a game operator, for example. Also, a monitoring arrangement separate from player terminals 14 may monitor winnings and a player may be required to redeem winnings or credits at a cashier or monitoring station.

Game play records for the different games used in the invention may be generated by any suitable means. For example, once a desired quantity of each potential result is determined for a particular game, that number of game play records for each result may be generated by a suitable method. Thus, each game play record corresponds to a result in the lottery game. Once the records are generated, they may be shuffled or otherwise randomized electronically in a separate randomization step. Both the game play record generation and randomization may be performed at a separate game manufacturing system such as system 11 shown in FIG. 1.

The randomized game play records may be arranged in groups, and groups of randomized game play records may be transferred for distribution or sale to one or more separate computer systems such as the central processing system 12 shown in FIG. 1. These groups of randomized game play records are analogous to books of scratch-off tickets distributed to lottery retailers. As will be discussed in detail below with reference to FIGS. 2 and 3, the randomized game play records for each game are distributed sequentially to the various player terminals 14. This sequential distribution is analogous to the distribution of scratch-off tickets by a retailer.

Those skilled in the art will appreciate that the invention may be embodied in many arrangements other than the illustrative arrangement shown in FIG. 1. For example, a single computer system may generate the game play records according to the invention and may also store the game play records for distribution to several player terminals such as terminals 14. Furthermore, rather than randomizing an entire set of game play records and then distributing the records sequentially, the game play records could be drawn randomly and distributed from a sequentially arranged set of records. This alternative game record randomization technique is to be considered within the scope of the invention as set forth in the following claims.

Figure 2:
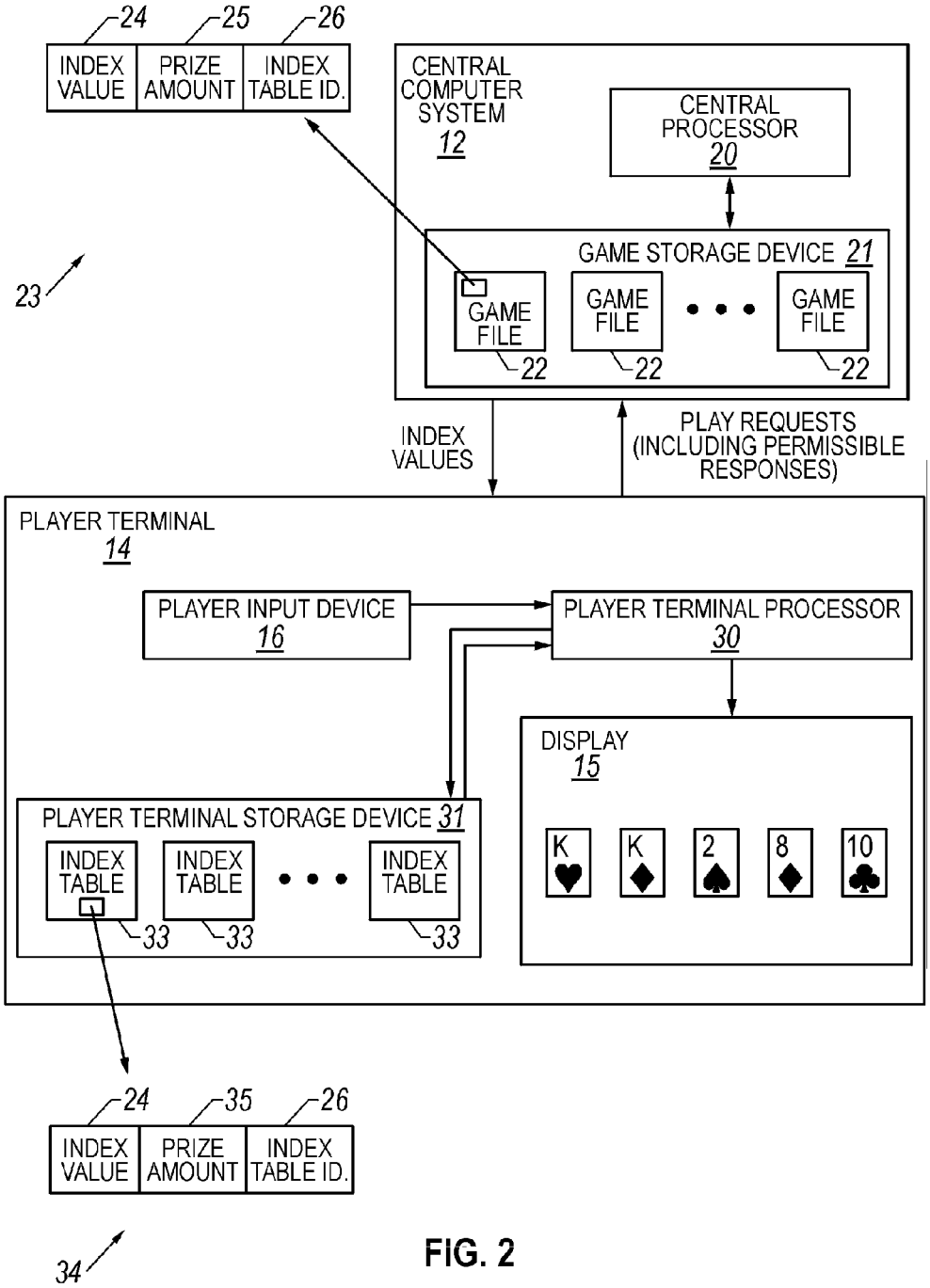
FIG. 2 is a diagrammatic representation of the central processing system and a single player terminal, showing data structures employed in the invention.

Referring to FIG. 2, central processing system 12 includes a play request or central processor 20 and a game play storage device 21. Those skilled in the art will appreciate that central processor 20 includes random access memory and other components which are omitted from the drawing so as not to obscure the invention in unnecessary detail. Central processor 20 executes program code to perform the method steps described below with reference to FIG. 3. Game play storage device 21 stores one or more game record files 22, each file comprising a pool of game play records 23. As shown in FIG. 2, each game play record 23 includes or has associated with it a record index 24. Each game play record may also include a table identifier 26, and perhaps other information such as prize amount 25 and further information which may be used for accounting and verification purposes.

Record indexes 24 associated with the various game play records are chosen from a set of unique record index values. Each record index value in this set is associated with a result type for a lottery-type game. For example, in a multi-level lottery-type game which imitates the play of draw poker, each record index value may be associated with one of ten different result types. Those ten different result types are preferably chosen to correspond to possible outcomes of a draw poker hand, namely, (1) no value (2) pair of jacks or better (3) two pair, (4) three of a kind, (5) four of a kind, (6) straight, (7) flush, (8) full house, (9) straight flush, and (10) royal flush.

FIG. 2 shows several different game record files 22 stored on game play storage device 21. This reflects the fact that multiple games may be in play at any given time in the present system, with each game having its own game play record pool. Even with one game in play, two or more different game record files 22 may be used alternately in retrieving game play records 23. Where different games are in play, the games may be entirely independent or may be related as initial and additional level games. Where multiple game record files 22 are used, each game record file is associated with some identifier to enable central processor 20 to distinguish between game record files and choose the correct game record file in response to a game play request from player terminal 14.

Central processing system 12 communicates record indexes 24 to player terminal 14. As indicated in FIG. 2, central processing system 12 also acts upon game play requests directed to the central processing system from the player terminal 14. It will be appreciated that numerous player terminals 14 may interact with the single central processing system 12 and that only a single terminal is shown in FIG. 2 in order to simplify the drawing for purposes of describing the invention.

Player terminal 14 includes a player terminal processor 30, input device 16, display device 15, and a player terminal storage device 31. As will be discussed below with reference to FIG. 3, player terminal processor 30 executes display control program code to generate display commands. These display commands are directed to display 15 to cause the display to produce a desired graphic representation. The graphic representation may include a representation of a paper scratch ticket for example. Alternatively, the graphic representation may be associated with a casino game or any other game type.

Player terminal storage device 31 stores all information required to produce a graphic representation based upon, and consistent with, a record index 24 received from central processing system 12, and the result type associated with the index value which makes up the record index. Where the graphic representation comprises a representation of a scratch-off ticket, for example, the information required to produce a graphic representation may include a file or object to draw the basic ticket and files or objects to draw any symbols which may appear on the ticket. For a lottery-type game which imitates draw poker, the graphic producing files or other arrangements of data may include files required to draw representations of the various cards which may be found in a poker hand. In either case, player terminal storage device 31 may comprise a mass storage device such as a hard drive associated with the player terminal, or may comprise random access memory or read-only memory associated with player terminal processor 30.

In one form of the invention, player terminal storage device 31 serves as an index table storage device for storing an index table 33 and perhaps several different index tables 33. Each index table 33 includes a series of table entries 34 with each table entry relating a different record index value to a prize amount 35. Each index table 33 may also be associated with a table identifier 26 to allow player terminal processor 30 to distinguish between the various index tables. Information relating record index values to prize amounts may also be incorporated in a single index table, with identifiers in the various table entries used to distinguish different table entries. Each table entry 34 may also include pointers to processes or programming required to generate the display commands necessary to produce a desired graphic representation.

Player input arrangement 16 may comprise a series of input devices (not shown) implemented in any suitable hardware to allow the player to make game play requests. Each player input preferably generates a game index value chosen from a set of game index values. Each game index value corresponds to an identifier for a particular game record file stored at central processing system 12. Thus, the game index value generated from a player input may represent a game play request to central processing system 12 and be used to identify a particular game record file 22 from which a record index 24 is to be read or drawn.

Figure 3:
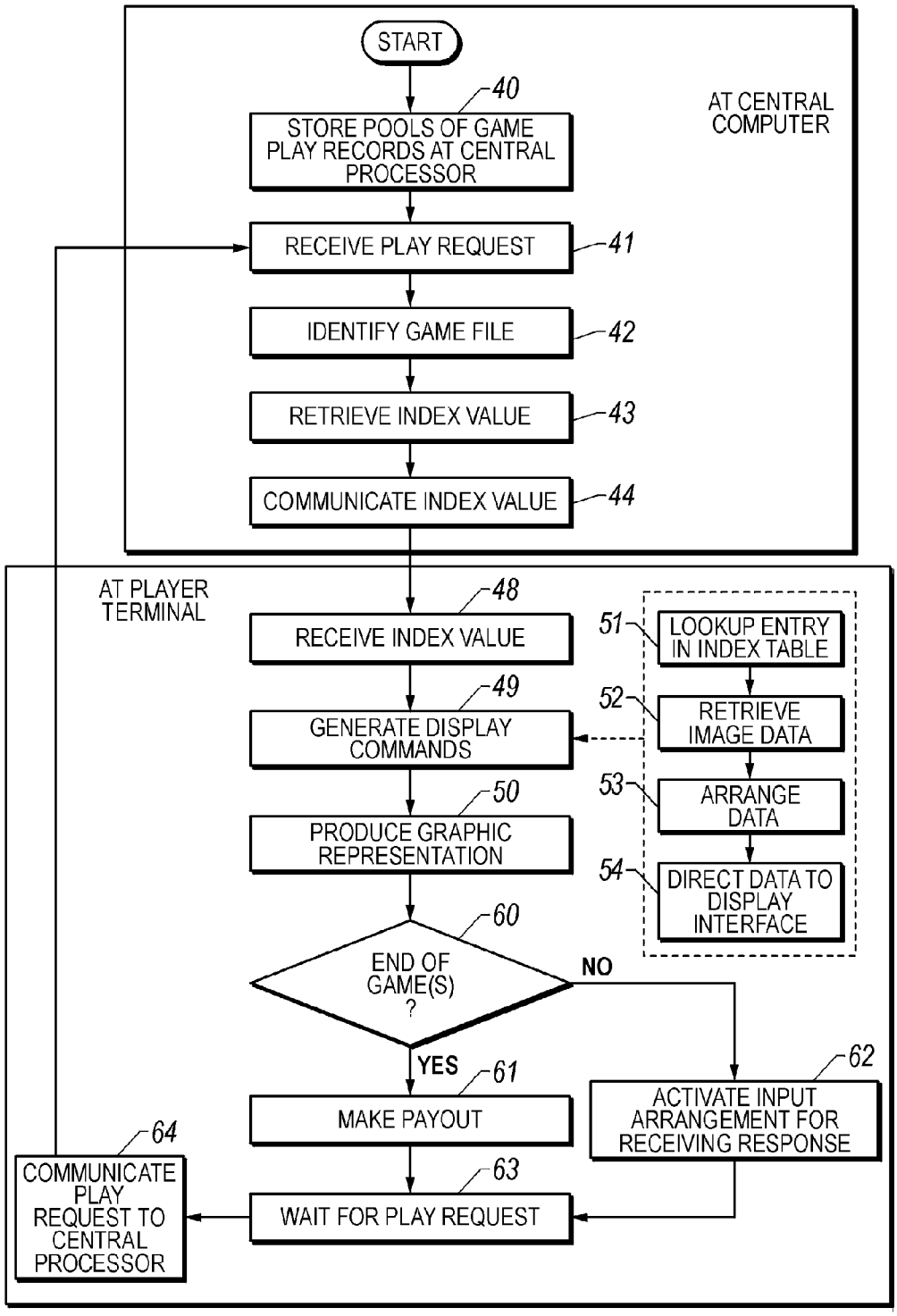
FIG. 3 is a flow chart illustrating a method embodying the principles of the invention and using the apparatus and data structures described with reference to FIGS. 1 and 2.

The flow chart shown in FIG. 3 indicates that part of the method according to the invention is performed at the central processing system (12 in FIGS. 1 and 2) and the remainder of the method is performed at the player terminal (14 in FIGS. 1 and 2). The method steps are performed by the respective computer hardware operating under control of computer program code. At central processing system 12, the method includes storing one or more pools of game play records as shown at process block 40 in FIG. 3. The pools of game play records may be embodied in computer files, specifically game record files 22, shown in FIG. 2, each game record file containing a series of game play records 23 for a particular game. As shown at process block 41 in FIG. 3, the method performed at central computer system 12 further includes receiving game play requests originating from player terminal 14. In the preferred form of the invention, several games may be played at a given time and therefore several different game record files will be stored at central processing system 12. Where several game record files are available, the method includes the step of determining which game record file 22 is to be used in response to the game play request. This game record file determination step is shown at process block 42 in FIG. 3. This step involves using information from the game play request to identify the appropriate game record file.

For example, in the preferred form of the invention, a game play request from player terminal 14 includes the game index value. Each different game index value is associated with a different game to be played and thus corresponds to a different game record file identifier and different game record file. In a preferred implementation the game index values comprise the game file identifiers, and the step of determining the appropriate game record file comprises simply reading the received game index value to identify the associated game record file 22. Otherwise look-up tables may be used at central processing system 12 to relate a received game index/game play request to a particular game file identifier and game record file 22.

Once the particular game record file 22 has been determined, the central processor program code causes the record index associated with the next available game play record to be retrieved as shown at step 43. The program code, that is, play request processing program code included with the central processor program code then, at step 44, causes central processing system 12 to communicate the retrieved record index to the player terminal 14.

As discussed above with reference to FIG. 2, several different index tables may be stored at player terminal 14, each identified by a different table identifier. Where different index tables are used at player terminal 14, the method at central processing system 12 includes retrieving the table identifier associated with the particular record index along with that record index. This table identifier is then communicated to player terminal 14 along with the record index at step 44.

The method steps performed at player terminal 14 include receiving the record index communicated from central processing system 12, as shown at step 48 in FIG. 3. At step 49, the method next includes generating display commands in response to the received record index. This method step is performed by display control program code executed at player terminal processor 30. These display commands are then directed to display 15 to produce the desired graphic representation at step 50. This graphic representation is consistent with the result type associated with the received record index and, in the event that the game comprises an additional level game, is also consistent with the permissible response entered by the player in response to the earlier or initial graphic representation, and the earlier graphic representation itself.

Generating the required display commands may be accomplished in several different fashions through suitable display control software at player terminal 14. In one preferred arrangement, the index table with which the received record index is associated is queried at step 51 to look up the prize amount associated with the index value comprising the record index. The table entry for the record index value may also include a pointer to a subroutine or program code. This subroutine is then executed at step 52 to retrieve image data from an image library stored at player terminal storage device 31 shown in FIG. 2. The subroutine arranges the image data as appropriate at step 53. This image data represents the display commands which are directed to display 15 through a suitable interface (not shown) at step 54.

If the game play request (including or comprising a game index value) which prompted receipt of the record index indicates that the received record index is not related to any other game, as indicated at decision block 60 in FIG. 3, the method may continue with the step of making the indicated payout at step 61. As discussed above, the payout may be in the form of coins or tokens issued at player terminal 14, credits applied at the player terminal, or a ticket printed at the player terminal, for example.

At decision block 60, if the game play request (game index value) which prompted receipt of the record index indicates that the received record index is related to another game, then program code executing at player terminal 14 may, at step 62, activate input arrangement 16 at the terminal to enable the player to make a permissible response. A payout step may or may not be included with activation step 62. After either step 61 or 62, player terminal 14 is directed by its program code to wait for an appropriate input from the player. This waiting step is shown at 63 in FIG. 3. Upon entry of the appropriate input, the method includes at step 64 communicating the input as a game play request to central processing system 12. As mentioned above, this game play request preferably comprises a game index value generated in response to activation of a particular input button or other input device included in input arrangement 16 at the player terminal.

The operation of the invention may be described with reference to two specific examples along with FIGS. 2 and 3. In a first example, the games implemented through the invention comprise scratch-off ticket type games in which a representation of a ticket appears on display 15. The ticket representation may include, for example, a series of five symbols with the degree to which the symbols match indicating the result of the game play. In this example, the player enters a game play request at process block 64 in FIG. 3. This game play request comprises a game index value which is associated with a particular game and game record file 22 at central processing system 12. Upon receipt of the game index value, central processing system 12 uses the game index value to identify the appropriate game record file 22 and then retrieves a record index from the identified game record file (steps 41 through 43 in FIG. 3).

The retrieved record index is then communicated to player terminal 14 where it is used to generate display commands (steps 49 and 51-54) using information stored at player terminal storage device 31. The display commands produce a graphic representation (step 50) which provides an indication whether the game play record with which the index value is associated is a winning or losing game play record. The graphic representation may, for example, show five symbols with three matching. The graphic with three matching symbols may represent some level of win with a particular prize amount obtained from the index table information at player terminal 14. Finally, the prize may be paid out (step 61) and/or the player terminal input arrangement 16 may be activated (step 62) to allow the player to make another input to enter the same game or a different game. The next game may be related in some way to the just completed game or may be entirely unrelated.

A game intended to imitate a draw poker game may be used to describe a multi-level lottery-game. In this example, a player at player terminal 14 enters an initial game play request at step 64 similarly to the previous example. Central processing system 12 receives the game index value representing the game play request and determines that the game play request is for a play in an initial level game having game play records stored in a particular game record file 22. Central processing system 12 retrieves a record index from the next available entry in the game record file 22 and communicates the retrieved record index to player terminal 14 just as in the previous example.

For purposes of this example assume that the record index is associated with the result type "jacks or better." The display control program code operating at player terminal 14 responds to this record index by generating display commands to produce a graphic representation consistent with the result type associated with the index value comprising the record index. It will be noted that the record index communicated from central processing system 12 does not indicate the specific representation nor does it indicate the outcome, that is, prize value, associated with the game play record. Rather the record index is used to look up the result and type of representation, a draw poker hand having the value "jacks or better." It is the display control program code which generates the display commands to produce a specific graphic representation consistent with this result type. For example, the display commands generated generally at step 49 in FIG. 3 may produce a graphic representation at display 15 of a draw poker hand including five different graphic symbols, the king of hearts, the king of diamonds, the two of spades, the eight of diamonds, and ten of clubs.

After this graphic representation is produced at display 15 (step 50), the player terminal program code activates input arrangement 16 to allow the player to enter some permissible response at the player terminal. The particular response is communicated to central processing system 12 and represents a game play request in a particular second level game. The game play request is embodied in a game index value similarly to the request in the preceding game. For purposes of example, assume the player enters a response holding the pair of kings and discarding the remaining cards shown in the graphic representation. Central processing system 12 uses the game index value associated with this response to identify a game record file 22 for a game which may be referred to as the "jacks or better" game, and then at step 43 in FIG. 3 retrieves an index value from an entry in that file for communicating to player terminal 14.

In response to the additional record index from the additional level game, display control program code operating at player terminal 14 then generates second level display commands to produce an additional level graphic representation at display 15. This additional level graphic representation displays the outcome of the play to the player and must be consistent both with the graphic representation associated with the initial level game and with the result type associated with the record index received in the additional level game. For example, assume the additional level record index comprises an index value associated with the result type "three of a kind." In this case, the display commands produce a graphic representation comprising three kings and two additional cards which do not add to the value of the hand. Again, the record index did not dictate the suit of the additional king or the values of the two other cards. These results are generated by the display control program code operating at player terminal 14. The additional level game representation may include in this example the king of hearts, king of diamonds, king of spades, seven of hearts, and ace of clubs. This graphic representation is thus consistent with the earlier graphic representation in that it retains the two cards held in the player response to the first level game. Additionally, the additional level graphic representation is consistent with the result type associated with the index value comprising the additional level record index retrieved in the additional level game.

As used herein, whether in the above description or the following claims, the terms "comprising," "including," "carrying," "having," "containing," "involving," and the like are to be understood to be open-ended, that is, to mean including but not limited to. Only the transitional phrases "consisting of" and "consisting essentially of," respectively, shall be considered exclusionary transitional phrases, as set forth, with respect to claims, in the United States Patent Office Manual of Patent Examining Procedures (Eighth Edition, August 2001 as revised October 2005), Section 2111.03.

The above described preferred embodiments are intended to illustrate the principles of the invention, but not to limit the scope of the invention. Various other embodiments and modifications to these preferred embodiments may be made by those skilled in the art without departing from the scope of the following claims. For example, although the multi-level game described above comprises a two level game, it will be appreciated that the multi-level games may comprise any number of game levels which are graphically related or not.

The invention claimed is:

1. A method for facilitating game play in an electronic lottery game played over a network, the method including:

(a) receiving an input at a player terminal connected to the network to initiate a game play request for a game play record selected from a pool of game play records, the game play record including a record index selected from a set of unique index values each corresponding to a respective result type, the result type being a type of game play result for which multiple different outcomes are possible for each result type in game play;

(b) at the player terminal, receiving the record index included with the game play record;

(c) responsive to the receipt of the record index at the player terminal, causing a display device at the player terminal to display a graphic representation made up of a number of graphic symbols, the graphic representation being consistent with the result type and representing an outcome for the game play request, the outcome being one of the multiple different outcomes possible for the result type corresponding to the record index, one of the number of graphic symbols being selected from alternative graphic symbols by a processing device at the player terminal without being specified by the record index; and (d) displaying the graphic representation with the display device.

2. The method of claim 1 wherein each graphic symbol included in the number of graphic symbols displayed at the player terminal is selected from alternative graphic symbols by the processing device at the player terminal without being specified by the record index.

3. The method of claim 1 wherein the number of result types is smaller than the number of game play records included in the pool of game play records.

4. The method of claim 1 wherein each of the number of graphic symbols comprises a graphic representation of a playing card face.

5. The method of claim 1 wherein the game play request includes a game index value which identifies the pool of game play records from among additional pools of game play records stored at a central processing system.

6. The method of claim 1 further including:

(a) storing an index table at the player terminal, the index table including a table entry corresponding to each different record index in the set of indexes; and (b) performing a table lookup in the index table to locate the table entry for the record index received at the player terminal.

7. The method of claim 1 further including:

(a) storing a number of index tables at the player terminal, each index table including a respective table entry corresponding to each different record index in the set of indexes;

(b) identifying a respective one of the index tables; and (c) performing a table lookup in the identified index table to locate the respective table entry for the record index received at the player terminal.

8. A player terminal for facilitating game play of an electronic lottery system, the player terminal including:

(a) a player input device which is operable by a player to make an input to initiate a game play request for a game play record from a pool of game play records stored at a central processing system of the electronic lottery system, each game play record corresponding to a result in a lottery game and including a record index selected from a set of unique index values each corresponding to a respective result type, the result type being a type of game play result for which multiple different outcomes are possible for each result type in game play, the record index included with a respective game play record being distinct from a prize value associated with that game play record;

(b) a player terminal processor for receiving a record index communicated to the player terminal responsive to the game play request, and, in response to the received record index, generating display commands for a graphic representation made up of a number of graphic symbols, the graphic representation being consistent with the result type associated with the received record index and representing an outcome for the game play request, the outcome being one of the multiple different outcomes possible for the result type corresponding to the record index, one of the number of graphic symbols being selected from alternative graphic symbols by the player terminal processor without being specified by the record index; and (c) a display device operatively connected for displaying the graphic representation.

9. The player terminal of claim 8 wherein the central processing system stores one or more additional pools of game play records and wherein the game play request includes a game index value which identifies the pool of game play records from among the additional pools of game play records.

10. The player terminal of claim 8 further including:

(a) an index table storage device at the player terminal, the index table storage device storing an index table that includes a table entry corresponding to each different record index in the set of indexes; and (b) wherein the player terminal processor performs a table lookup in the index table to locate the table entry for the record index received at the player terminal.

11. The player terminal of claim 8 further including:

(a) an index table storage device at the player terminal, the index table storage device storing a number of index tables with each index table including a respective table entry corresponding to each different record index in the set of indexes;

(b) wherein the player terminal processor identifies a respective one of the index tables based on a game index and performs a table lookup in the identified index table to locate the respective table entry for the record index received at the player terminal.

12. A gaming server system for facilitating game play in an electronic lottery game played over a network, the server system including at least one computing device connected to the network and comprising:

(a) first program code configured to, when executed, cause the server system to receive, over the network a game play request and in response select a game play record from a pool of game play records, the game play record including a record index selected from a set of index values each corresponding to a respective result type, the result type being a type of game play result for which multiple different outcomes are possible for each result type in game play;

(b) second program code configured to, when executed, cause the server system to transmit over the network to a player machine the record index included with the game play record; and (c) wherein the electronic lottery game is configured such that the record index contains sufficient information to allow a graphic representation to be formed made up of a number of graphic symbols, the graphic representation being consistent with the result type and representing an outcome for the game play request, the outcome being one of the multiple different outcomes possible for the result type corresponding to the record index, one of the number of graphic symbols being selected from alternative graphic symbols without being specified by the record index.

13. The server system of claim 12 wherein each graphic symbol included in the number of graphic symbols is able to be selected from alternative graphic symbols being specified by the record index.

14. The server system of claim 12 wherein the number of result types is smaller than the number of game play records included in the pool of game play records.

15. The server system of claim 12 wherein each of the number of graphic symbols comprises a graphic representation of a playing card face.

16. The server system of claim 12 wherein the game play request includes a game index value which identifies the pool of game play records from among additional pools of game play records stored at the central processing system.

* * * * *